US009841235B2

(12) United States Patent
Mosshammer et al.

(10) Patent No.: US 9,841,235 B2
(45) Date of Patent: Dec. 12, 2017

(54) SUBSTRATE TREATMENT PROCESS

(71) Applicant: VON ARDENNE GMBH, Dresden (DE)

(72) Inventors: Steffen Mosshammer, Rabenau (DE); Thomas Meyer, Dresden (DE); Michael Brandt, Coswig (DE)

(73) Assignee: VON ARDENNE GMBH, Dresden (DE)

( * ) Notice: Subject to any disclaimer, the term of this patent is extended or adjusted under 35 U.S.C. 154(b) by 162 days.

(21) Appl. No.: 14/445,878

(22) Filed: Jul. 29, 2014

(65) Prior Publication Data

US 2015/0044621 A1 Feb. 12, 2015

(30) Foreign Application Priority Data

Aug. 6, 2013 (DE) ..... 10 2013 108 449
Feb. 18, 2014 (DE) ..... 10 2014 102 002

(51) Int. Cl.
*F27B 9/20* (2006.01)
*F27B 9/14* (2006.01)
*F27B 9/40* (2006.01)

(52) U.S. Cl.
CPC ..... *F27B 9/20* (2013.01); *F27B 9/14* (2013.01); *F27B 9/40* (2013.01)

(58) Field of Classification Search
None
See application file for complete search history.

(56) References Cited

U.S. PATENT DOCUMENTS 6,282,923 B1 * 9/2001 Vehmas ..... C03B 29/08 65/114
6,543,325 B1 * 4/2003 Newhouse ..... B26D 7/0616 83/703
2008/0060744 A1 * 3/2008 Sklyarevich ..... B32B 17/10036 156/104

FOREIGN PATENT DOCUMENTS

DE 102008024372 A1 12/2009
DE 10 2010 043804 A1 5/2012
DE 102010043804 A1 5/2012
WO 2009004048 A1 1/2009

* cited by examiner

*Primary Examiner* — Alissa Tompkins
*Assistant Examiner* — John Bargero
(74) *Attorney, Agent, or Firm* — Heslin Rothenberg Farley & Mesiti P.C.

(57) ABSTRACT

In a substrate treatment process, substrates are moved by a transporting device in a transporting direction through a substrate treatment installation having a number of chambers. The substrates are moved by transporting sections of the transporting device driven independently of one another. The transporting sections are driven such that, if substrates dwell temporarily in the transporting section, they are moved back and forth. Stresses in a substrate brought about by differing inputs of heat as a result of both process-induced and malfunction-induced dwell times of the substrate in a chamber are reduced by compensating within the chamber for a structurally brought about input of heat into the substrate, varying periodically over the length of the chamber, during temporary dwelling of the substrate in the chamber by moving the substrate back and forth over at least one period of the heat input by a change of the transporting direction.

8 Claims, 2 Drawing Sheets

SUBSTRATE TREATMENT PROCESS

CROSS REFERENCE TO RELATED APPLICATIONS

Figure 1:
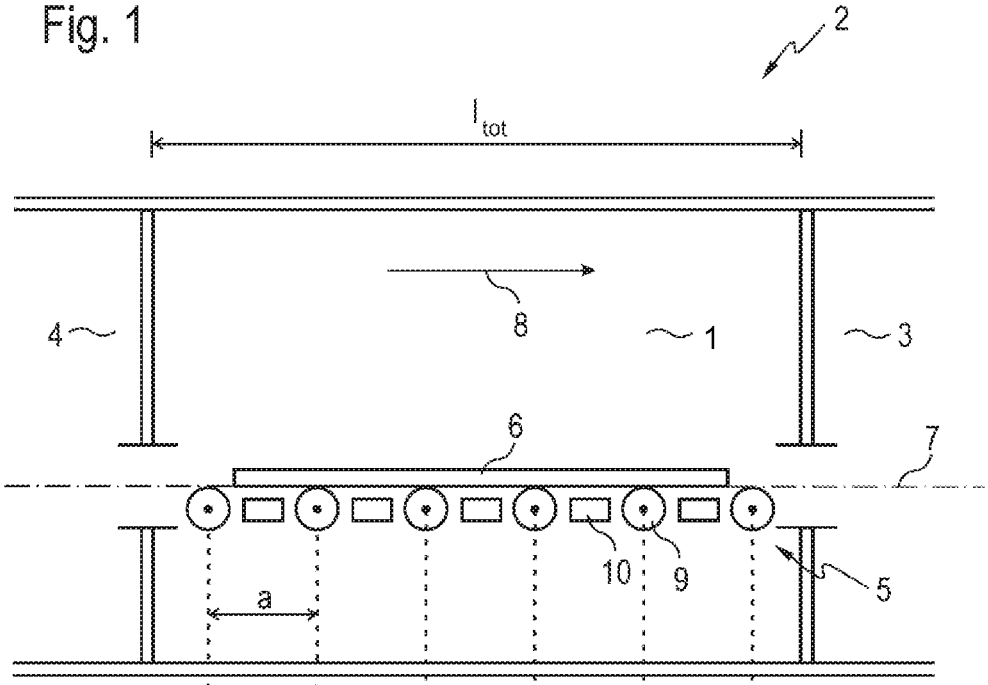

This application claims priority of German application No. DE 10 2013 108 449.4 filed on Aug. 6, 2013, and German application No. DE 10 2014 102 002.2 filed on Feb. 18, 2014, the entire disclosure of these applications being hereby incorporated herein by reference.

BACKGROUND ART

The invention relates to a substrate treatment process, in which substrates are moved by means of a transporting device in a transporting direction through a substrate treatment installation consisting of a number of chambers, the substrates being moved by way of transporting sections of the transporting device that are driven independently of one another and the transporting sections of the transporting device being driven in such a way that, if they dwell temporarily in the transporting section, substrates arranged on them are moved back and forth.

A substrate treatment process should be understood here as meaning in particular a process for applying and/or removing a surface layer of a substrate, in particular a substrate in sheet form, for example a plate of glass or the like, in which the substrate is heated by a substrate treatment device, for example a coating device, dry-etching device or the like, or/and by a heating device additionally arranged in a substrate treatment installation.

In dependence on the substrate treatment process to be realized in the substrate treatment installation, the substrate to be treated is exposed to differing process temperatures and temperature regimes in different chambers of a substrate treatment installation. The temperatures that the substrates assume are of decisive importance for the quality of the result of the treatment.

It is known that substrates that are treated in a continuous vacuum coating installation are moved through the vacuum coating installation in a transporting direction that lies in the longitudinal extent of the substrates. This vacuum coating installation likewise has in a longitudinal extent that lies in the transporting direction a number of functional chambers. For example, the vacuum coating installations are designed as 3-chamber installations or as 5-chamber installations.

A 3-chamber installation consists of

- a first functional chamber, to be specific the entry lock, which also represents one physical chamber of the installation,
- a second functional chamber, often consisting of a number of physical chambers of the installation, to be specific
  - a first transfer chamber (in one physical chamber of the installation),
  - a process chamber (usually in a number of physical chambers of the installation) and
  - a second transfer chamber (in one physical chamber of the installation), and
- a third (functional) chamber, to be specific the exit lock, which in turn represents one physical chamber of the installation.

A 5-chamber installation consists of

- a first functional chamber, to be specific the entry lock, which also represents one physical chamber of the installation,

- a second functional chamber, to be specific a first buffer chamber, which also represents one physical chamber of the installation,
- a third functional chamber, consisting of a number of physical chambers of the installation, to be specific
  - a first transfer chamber (in one physical chamber of the installation),
  - a process chamber (usually in a number of physical chambers of the installation) and
  - a second transfer chamber (in one physical chamber of the installation),
- a fourth functional chamber, to be specific a second buffer chamber, which also represents one physical chamber of the installation, and
- a fifth (functional) chamber, to be specific the exit lock, which in turn represents one physical chamber of the installation.

In the individual chambers, the substrates are exposed to differing inputs of heat. Depending on whether a heating-up or just a transfer of the substrate to the next process chamber or a controlled cooling-down is intended in the respective chamber, a positive or negative input of heat is concerned. If the substrate is heated by heaters, which are for example arranged between transporting rollers of the transporting device, there is a positive input of heat. If, on the other hand, in the case of a non-heated chamber, heat is dissipated from the substrate into the chamber by way of the transporting rollers or by heat conduction or heat radiation, there is a negative input of heat.

In a 5-chamber installation, a substrate is for example heated up to a temperature of about 200° C. upstream of the process chamber in the transporting direction. In this case it is known to arrange a number of heaters lying one behind the other in the transporting direction between the transporting rollers of the transporting device. In this case, each heater brings about an input of heat of its own to the substrate.

With these active heating measures, the substrates can become very intensely heated and there is the problem that differingly hot zones form in the chambers. During normal operation, that does not present a problem, since the substrates are moved continuously through the substrate treatment installation and a dynamic energy balance is thus established. As a result, there is what is known as a smoothing of the temperature profile on the substrate that forms in a chamber.

At the moment that the transporting device that brings about the movement of the substrates suddenly comes to a standstill, for example when there is a backup of substrates, the situation changes fundamentally. Typically, in such a case all heat sources, that is to say heating devices, or else all substrate treatment devices, such as coating or etching devices, must be switched off immediately and the transporting of the substrates stopped. On account of the resultant standstill of the substrates, there is no longer any smoothing of the temperature profile that forms on the substrate. I.e. parts of the substrate that are located on a hot region at the time of the standstill, for example directly over a heater, are heated up further in an uncontrolled manner. This is even the case when the heat sources are switched off, because both the heat sources and other, likewise heated-up components of the installation continue to radiate heat. The dynamic energy balance is disturbed. This situation leads to thermal stresses in the substrates, as a consequence of which they may bend or even break.

DE 10 2010 043804 A1 describes for example a process that serves for limiting damage in the event of a fault occurring, a process in which, if there is a malfunction, the substrate is moved back and forth in one section of the transporting device over a length of the substrate, in order to achieve a homogenization of the temperature in the substrates.

However, it may also be the case that it is predetermined in a process sequence for the treatment of a substrate that a substrate must dwell longer in a chamber, in order for example to shorten cycle times or in cases in which irregularities occur during cyclical operation, for example when there are gaps between substrates. If no allowance is made for such cases, and there is no appropriate response to them, there may be instances of bending of the substrate to the extent that it breaks, necessitating long times to restore the situation. However, when there is dwelling in a chamber, it is also necessary to compensate for a heat profile, for example a heat profile that occurs periodically over the length of the chamber, is brought about in particular by an arrangement of a number of heaters lying one behind the other in the transporting direction between the transporting rollers of the transporting device and would lead to a periodic temperature profile over the length of the substrate in the transporting direction. This is so because, even if such a temperature profile would not lead to glass breakage or the like, the temperature profile would be imposed on the substrate and would not be compensated quickly enough in downstream treatment steps, and would consequently lead to variations in quality in downstream treatment steps. It could thus happen for example that downstream coating operations would produce layers with a streaky appearance.

There is therefore the need for an improved substrate treatment process to reduce differing inputs of heat that bring about stresses on the substrate as a result of both process-induced and malfunction-induced dwell times of the substrate in a chamber of the substrate treatment installation.

BRIEF SUMMARY OF THE INVENTION

Proposed for this purpose is a substrate treatment process in which there is within a chamber of the substrate treatment installation compensation for a structurally brought about input of heat into the substrate, varying periodically over the length of the chamber, during temporary dwelling of the substrate in the chamber by a substrate that is located in the chamber concerned being moved back and forth over at least one period of the heat input by a change of the transporting direction. The advantage of this process is that a homogenization of the temperature of a substrate is brought about over an oscillating distance that is much shorter than the length of substrate, and it is thereby possible to avoid stresses in the substrate to the extent of breakage, or at least imposition of a periodic temperature profile. A structurally brought about input of heat, varying periodically over the length of the chamber, may in this case be the heat input as a result of a heater or else the heat dissipation by way of the transporting rollers, which are arranged alternatingly one behind the other.

In an advantageous refinement of the process, this process is performed during dwelling of the substrate in a buffer chamber. A buffer chamber in this case represents a heating chamber, for which it has proven to be advantageous to heat the substrate to be treated to a predeterminable initial temperature, for example 200° C., upstream of an actual region of the process.

In a further advantageous refinement of the process, this process is performed in a transfer chamber. A transfer chamber in this case represents the connection between two chambers, for example a buffer chamber and a process chamber. In the transfer chamber, the dwell time of a point on the substrate in the transfer chamber, and consequently the heat radiation that is taken up, depends on the position of the point on the substrate. This means that the manner in which a hot substrate is transported through the installation is decisive for the homogeneous formation of the temperature profile in the material. It is important that it is ensured that the substrate remains constantly in motion.

Therefore, the periodic change of the transporting direction in the proposed process should take place on the basis of a trapezoidal velocity function. This means that the velocity of the substrate between the reversal points of the substrate movement is constant, and consequently each point on the substrate undergoes the same input of heat. At the reversal points, the change in the direction of movement should take place as quickly as possible, so that even there every point on the substrate undergoes virtually the same input of heat. Ideally, the periodic change of the direction of transport in the proposed process should take place virtually on the basis of a rectangular velocity function, i.e. the change of direction takes place as quickly as possible.

In a refinement of the proposed process, the smallest length of the oscillating movement is determined by the duration of the period or by a spacing between two transporting rollers arranged following one another in the transporting direction. This allows the length of the installation to be shortened and nevertheless a homogeneous input of heat over the entire substrate to be realized during dwell times of the substrate in a chamber. Optimum results can be achieved if the length of the oscillating movement corresponds to an integral multiple of the duration of the period or the spacing between two transporting rollers arranged following one another in the transporting direction. As is known, in regions in which the substrate is heated, the heaters are preferably arranged between the transporting rollers.

In order to ensure optimum temperature control of the substrates to be treated, the operation of all the sections of the transporting device arranged downstream is monitored and, if there is detection of a backup and/or in accordance with a process sequence to be predetermined for the treatment of substrates, the transporting sections concerned of the transporting device are switched over from a continuous forward movement to a periodic change of the transporting direction.

BRIEF DESCRIPTION OF THE DRAWING FIGURES

Figure 2:
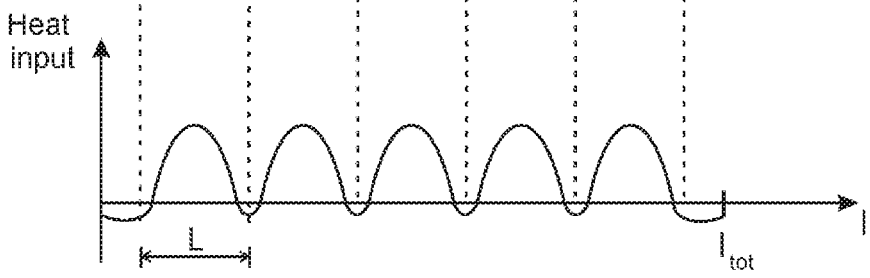
Figure 3:
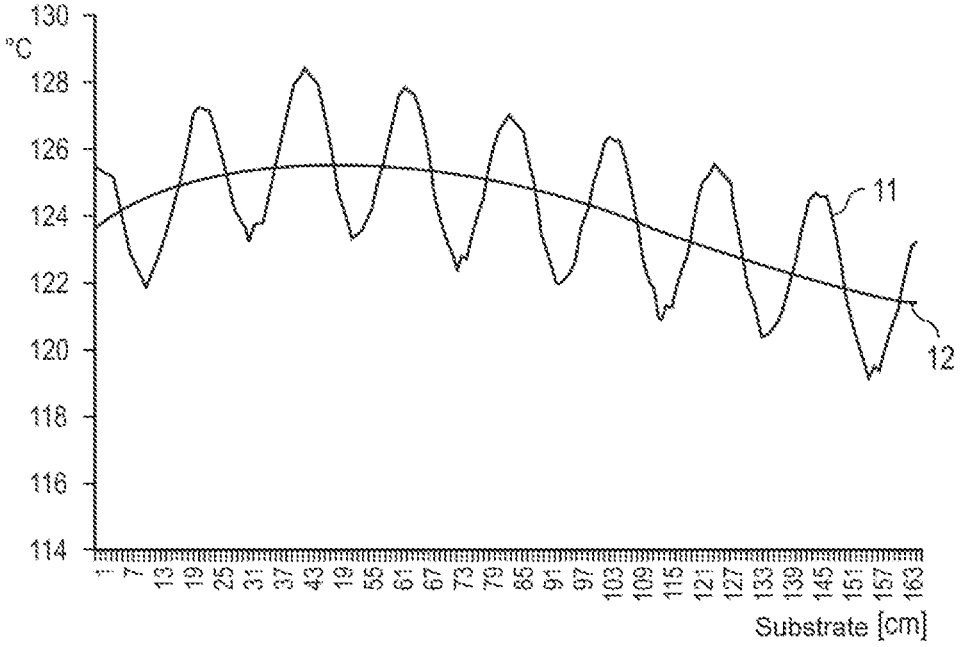

The invention is to be explained in more detail below on the basis of an exemplary embodiment. In the associated drawing:

FIG. 1 shows a schematic cross-sectional representation of a detail of a substrate treatment installation, FIG. 2 shows a heat input profile within the chamber and FIG. 3 shows the temperature profile forming on a substrate to be treated at a standstill and when the proposed process is being used.

DETAILED DESCRIPTION

In FIG. 1, a chamber 1 of a substrate treatment installation 2, which also has further chambers 3 and 4, is schematically represented.

In this chamber 1, a transporting device 5 for transporting a substrate 6 is provided. This allows the substrate 6 to be moved in a substrate transporting plane 7 in the longitudinal direction 8.

FIG. 1 indicates a cross section through part of a substrate treatment installation 2, which consequently extends in width transversely in relation to the longitudinal direction 8, as it were through the plane of the page.

The transporting device 6 has driven transporting rollers 9, which extend longitudinally over the width of the substrate transporting plane 7, i.e. transversely in relation to the longitudinal direction of the substrate treatment installation. Arranged between the transporting rollers 9 are heaters 10, which serve for heating up the substrate 6. The alternation of transporting roller 9 and heater 10 produces a periodic profile of an input of heat into the substrate 6, i.e. the intensity of the input heat into the substrate, as is represented in FIG. 2 over the length 1 of the chamber 1, which has a total length l.sub.tot.

As can be seen, for structural reasons, the input of heat changes periodically to form a heat input profile occurring periodically over the length 1 of the chamber 1, with a period L, which corresponds to the spacing a between two transporting rollers 9.

When there is a movement of the substrate 6 on the transporting rollers 9, the differing input of heat into the substrate 6 is compensated. If, however, the substrate 6 must dwell in the chamber 1, for example because further transport into the following chamber 4 is not possible, the heat input profile would emerge as the temperature profile over the length of the substrate 6 if the substrate were to come to a standstill, such as that represented in FIG. 3.

According to the invention, this is compensated by a substrate 6 located in the chamber 1 concerned being moved back and forth over at least one period L of the heat input by a change of the transporting direction 5. For this purpose, the transporting device 5 is designed in such a way that it forms an independently controllable transporting section in the region of the chamber 1.

If the substrate 6 is moved at a constant velocity, the differences in temperature between the heater 10 and the transporting roller 9 are compensated completely after each distance over a roller spacing a. The available distance is usually limited to one or two roller spacings a. Therefore, the substrate 6 is moved back and forth (oscillated) n times. In order to keep down the negative influences due to the velocity not being constant at the necessary reversal points, the changing of the direction of movement should take place as quickly as possible. According to experience, the oscillating velocity should be at least 2 m/min. A controller calculates the velocity such that n complete roller spacings a or complete periods L are covered by precisely the end of the dwell time.

In FIG. 3 it can be seen that a further temperature profile 12 is superposed on the periodic temperature profile 11 of the substrate 6 that would be obtained when the substrate is at a standstill. This results from the velocity not being constant at transitions from rapid transfer movements to slow oscillating movements. It is therefore also necessary here to pay particular attention that transfers in heated regions move at a constant velocity and the change to a different velocity takes place as quickly as possible.

It must therefore be ensured for example when treating glass substrates that, in a very hot temperature regime, they always remain in motion. As soon as dwelling in a chamber is intended for process-related reasons, the glass substrate must nevertheless be kept in motion. Preferably, the substrate 6 is then moved back and forth by a transporting roller spacing a in such a way that the change between the back and forth movements takes place as quickly as possible. If the glass substrate were to dwell in one position, the differing temperature zones in the chamber 1 would form on the glass substrate 6. The maximum temperature amplitude that would then form is dependent on the difference in temperature between the heaters 10 and the transporting rollers 9 and the velocity at which the substrate 6 is moved.

With oscillation of the substrate 6, the temperature profile 12 will then be established over the length of the substrate 6.

The invention claimed is:

1. A substrate treatment process, in which substrates are moved by a transporting device in a transport plane in a transporting direction through a substrate treatment installation having a number of chambers, the substrates being moved by transporting sections of the transporting device that are driven independently of one another and the transporting sections of the transporting device being driven in such a way that, if a substrate dwells temporarily in a first transporting section, the substrate arranged on the first transporting section is moved back and forth in an oscillating movement, wherein, within a chamber of the substrate treatment installation, compensation is provided for a structurally brought about input of heat into a substrate, an intensity of the input of heat varying periodically over a length of the chamber with a period corresponding to a spacing between two transporting rollers of the transporting device arranged following one another in the transporting direction, during temporary dwelling of the substrate in the chamber, by the substrate located in the chamber being moved back and forth over an oscillating distance of at least said spacing and less than a length of the substrate by a periodic change of transporting direction, wherein the periodic change of the transporting direction takes place on the basis of a trapezoidal velocity function, wherein the intensity of the input of heat into the substrate, varying periodically over a length of the chamber, is produced by arranging a series of heaters, below the transport plane, one behind another along the transporting direction interspersed between respective pairs of transporting rollers of the first transporting section, and wherein the oscillating distance corresponds to an integral multiple of the spacing between the two transporting rollers.

2. The substrate treatment process as claimed in claim 1, wherein the process is performed during dwelling of the substrate in a buffer chamber.

3. The substrate treatment process as claimed in claim 1, wherein the process is performed in a transfer chamber.

4. The process as claimed in claim 1, wherein the spacing is determined by a spacing between two transporting rollers of the first transporting section arranged following one another in the transporting direction, with a heater arranged between the two transporting rollers.

5. The process as claimed in claim 1, further comprising: monitoring operation of other sections of the transporting device arranged downstream of the first transporting section and, if there is detection of a backup and/or in accordance with a process sequence to be predetermined for the treatment of substrates, switching the first transporting section of the transporting device over from a continuous forward movement to the periodic change of the transporting direction.

6. The process as claimed in claim 1, wherein the substrate is moved back and forth in the chamber at a velocity such that n complete periods of the heat input are covered by precisely an end of dwell time of the temporary dwelling, n being a positive integer.

7. The process as claimed in claim 6, wherein said velocity comprises at least 2 meters/minute.

8. The process as claimed in claim 1, wherein the integral multiple equals one, and the oscillating distance is equal to the spacing.

* * * * *